US005916091A

United States Patent [19]

Schultz

[11] Patent Number: 5,916,091

[45] Date of Patent: Jun. 29, 1999

[54] END CURTAIN FOR GYMNASIUM SEATING

[76] Inventor: William L. Schultz, 1971 Weimaraner Way, Meridian, Id. 83642

[21] Appl. No.: 08/935,920

[22] Filed: Sep. 23, 1997

[51] Int. Cl.[6] ..... E04H 3/12

[52] U.S. Cl. ..... 52/8; 52/9; 52/63; 182/129

[58] Field of Search ..... 52/8, 9, 63, 182, 52/183; 160/330; 182/129

[56] References Cited

U.S. PATENT DOCUMENTS

| | | | |
|---|---|---|---|
| 2,755,009 | 7/1956 | Parker | 182/129 |
| 4,571,895 | 2/1986 | Lyman, Jr. | 52/9 |
| 5,240,058 | 8/1993 | Ward | 52/63 X |
| 5,661,928 | 9/1997 | Beu | 52/9 |

OTHER PUBLICATIONS

"Folding Bleacher Co." product brochure. Folding Bleacher Co., a subsidiary of Irwin Seating Co., publisher. Published prior to Feb. 7, 1994.

"Safway Spectator Seating" product brochure. Safway Steel Products, Inc., Milwaukee, WI, publisher. Published prior to Feb. 7, 1994.

"Wayne Gymnasium Seating" product brochure. Wayne Iron Works, Wayne, PA, publisher. Published prior to Feb. 7, 1994.

"Accuroll/75 Folding Seating" product brochure. Universal Bleacher Co., Champaign, IL, publisher. Published prior to Feb. 7, 1994.

"Telescopic Seating Systems—Interkal 1991" product brochure, Interkal Inc., Kalamazoo, MI, publisher. Published prior to Feb. 7, 1994.

*Primary Examiner*—Carl D. Friedman
*Assistant Examiner*—Brian E. Glessner
*Attorney, Agent, or Firm*—Ken J. Pedersen; Barbara S. Pedersen

[57] ABSTRACT

The invention is an end curtain for gymnasium seating which has a generally triangular piece of flexible fabric which is secured to the wall of the gymnasium at the back end of the seating, and which is attached to the lower front end of the seating. The fabric has a cable or sturdy cord which is enclosed in a seam of the fabric along its longest (hypotenuse) side. The cable or cord in the hypotenuse side of the fabric is connected to the side edge of the seating by a plurality of looped hangers which pass through the fabric and around the cable or cord. This way, the weight of the fabric, chains, cables and or cords is distributed among the many hangers. Also, the looped hangers are adapted to not bind the cable or cord tightly. This way, the cable or cord in the seam of fabric along the hypotenuse side has enough give or travel through the many hangers to be flexible and not bind up or tear out at any particular hanger location. The fabric is secured at its three (3) corners to the wall of the gymnasium and to the lower front end of the seating.

3 Claims, 4 Drawing Sheets

END CURTAIN FOR GYMNASIUM SEATING

BACKGROUND OF THEE INVENTION

1. Field of the Invention

This invention relates generally to seating, and more specifically, to an end curtain for gymnasium seating. The invented curtain effectively and durably closes off the exposed side end of an extendable section of gymnasium or similar seating.

2. Related Art

For many years schools, for example, have used expandable bleacher and gymnasium seating. Typically, these expandable units roll or slide out from a folded-up, compact storage position into folded-out, extended position for use. This way, the units are stored out of the way for maximum use of gym floor space, during practice sessions, for example, and available quickly and easily for use as seating, during games, for example.

When these expandable units are extended, the side ends are usually open, creating a nuisance because spectators may crawl under the seating or throw litter there. Therefore, there has been a practice to close off the exposed side ends of the seating with flexible curtains. Still, these curtains have not been convenient or durable enough, due to the requirement that they flex to accommodate the seating in both the folded-up and folded-out positions. So, there is a need in the gymnasium seating industry for a convenient and durable end curtain. This invention addresses that need.

SUMMARY OF THE INVENTION

The invention is an end curtain for gymnasium seating which comprises a generally triangular piece of flexible fabric which is secured to the wall of the gymnasium at the back end of the seating, and which is attached to the lower front end of the seating. The fabric has a cable or sturdy cord which is enclosed in a seam of the fabric along its longest (hypotenuse) side. Also, the fabric has a chain, cable, cord or wire which is enclosed in a seam of the fabric along both of its short sides. The chains, cables, cords or wires are connected together at the corners of the fabric. Also, the fabric is secured at the corners to the wall of the gymnasium and to the lower front end of the seating.

The cable or cord in the hypotenuse side of the fabric is connected to the side edge of the seating by a plurality of looped hangers which pass through the fabric and around the cable or cord. This way, the weight of the fabric, chains, cables, cords or wires is distributed among the many hangers. Also, the looped hangers are adapted to not bind the cable or cord tightly. This way, the cable or cord in the seam of fabric along the hypotenuse side has enough give or travel through the many hangers to be flexible and not bind up or tear out at any particular hanger location.

DESCRIPTION OF THE PREFERRED EMBODIMENTS

Figure 1:
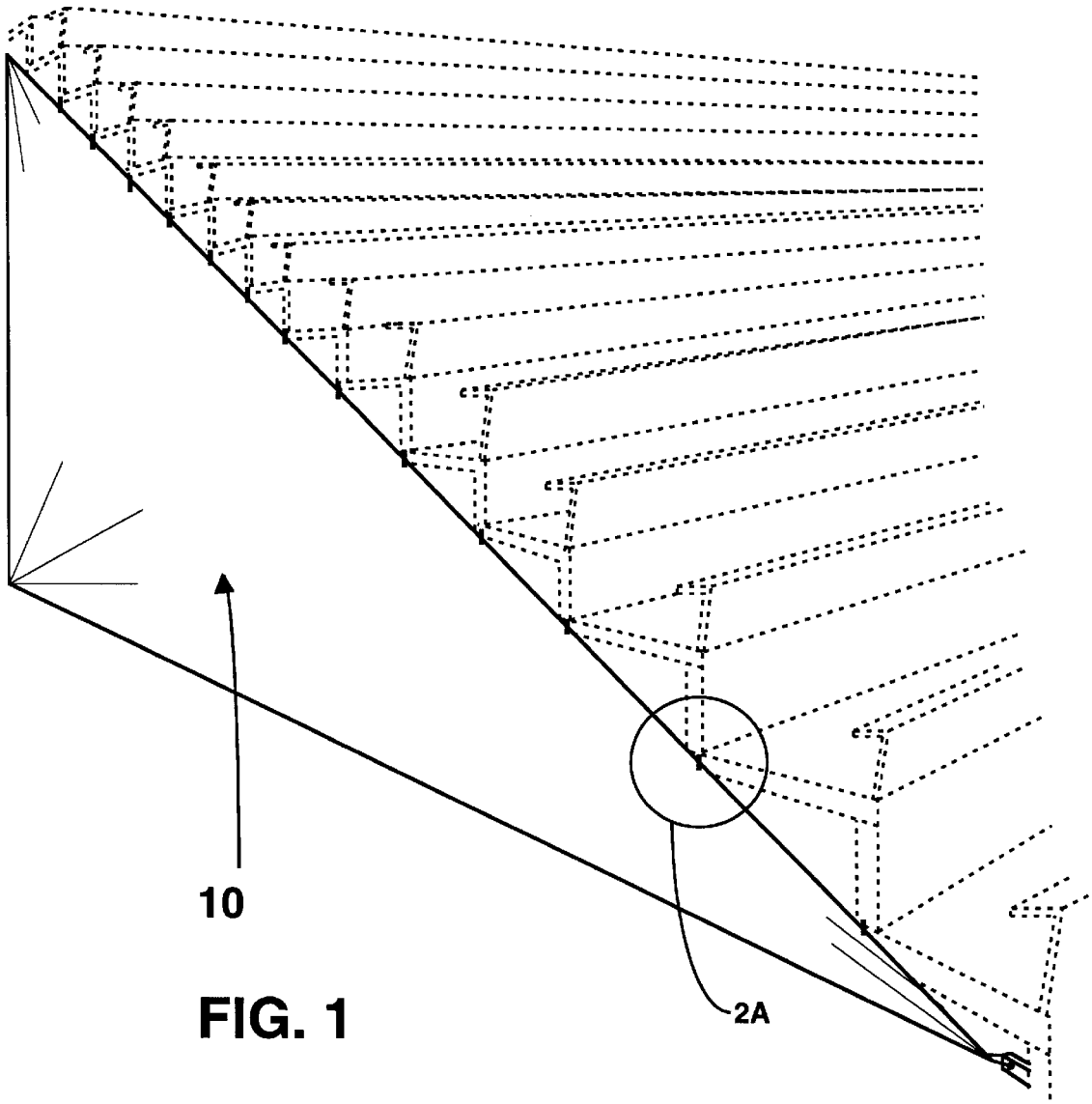
FIG. 1 is a side perspective view of one embodiment of the end curtain of the invention, showing it in the folded-out position.
Figure 2A:
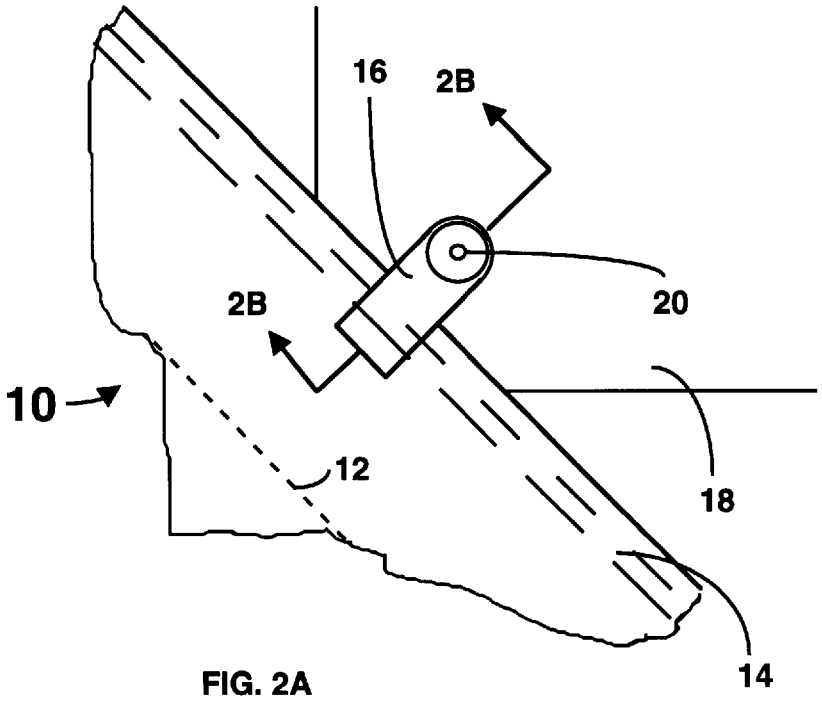
FIG. 2A is a partial detail view of a looped hanger assembly of the invention indicated at "2A" in FIG. 1.
Figure 2B:
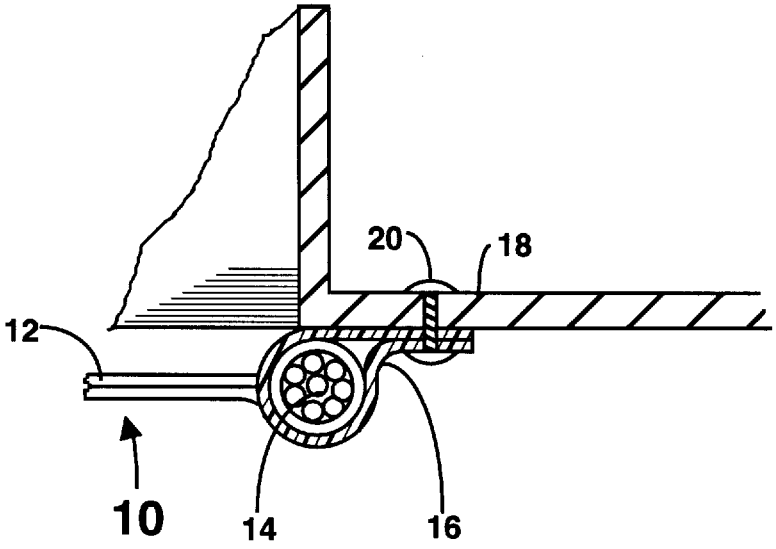
FIG. 2B is a partial, cross-sectional view along lines 2B—2B in FIG. 2A.

Referring to the Figures, there is depicted generally one embodiment 10 of the end curtain of the invention.

End curtain 10 is a generally triangular piece of flexible fabric. Preferably, curtain 10 is made of a durable, fire retardant polymer material, and may be woven with substantial space between intersection threads in order to allow substantial amounts of air and light to pass through. End curtain 10 must be strong and durable enough to prevent the ingress of spectators under the extended seating. Also, end curtain 10 must be flexible enough to permit the seating to be folded-out and folded-in again without binding or tearing.

End curtain 10 is generally triangular in shape because the end side of the extended seating to be enclosed is usually triangular in shape. In some cases, however, the end side of the seating may not be exactly triangular. For example, in some gymnasiums handicap access is provided in the first two rows of the seating. In these rows the seating is removed for the handicap access areas, and the end curtain is truncated accordingly with a vertical front edge of about 24 inches in height. Still, this shape is "generally triangular".

End curtain 10 has a seam 12 on each of its three (3) sides. Seam 12 encloses a chain, cable, cord or wire 14 which runs the length of, and parallel to, the sides of the curtain. Chain, cable or cord 14 helps provide substantial strength to the curtain sides. Also, chain, cable, cord or wire 14 in the hypotenuse side of curtain 10 helps provide substantial support for the weight of the curtain when it is supported by a plurality of looped hangers 16 spaced apart along the length of the side of the curtain and secured to the edge of the seating 18 by bolt 20.

Preferably, hypotenuse side 22 has a seam which encloses a sturdy steel cable. At each end the cable is fitted with a loop. The loop at the end of the cable is connected to preferably an end link of a chain which is enclosed in the bottom side and back side seams of curtain 10. The connection is preferably made by a single, threaded metal link 24 called a Quick Link™. The chain may be in one piece, extending from the lower front of the extended bleachers along the bottom side to the bottom back wall, and up from the bottom to the top of the bleachers along the wall. Or, the chain may be in two pieces—one piece extending from the lower front of the extended bleachers to the bottom back wall, and another piece extending from the bottom to the top of the bleachers along the wall.

Looped hanger 16 is preferably a fire retardant, durable plastic strip with a reinforced hole on both ends for receiving and being secured by bolt 20. Preferably, bolt 20 is a self-drilling, tapping #10 screw with a 5/16" hexagonal head. However, bolt 20 may be another conventional fastener, like a rivet or even a staple.

Looped hanger 16 passes through curtain fabric within seam 12 and encircles and supports chain, cable, cord or wire 14. This way, a plurality of hangers 16 effectively support the weight of curtain 10. Looped hanger 16 does not tightly bind chain, cable, cord or wire 14. This way, the chain, cable, cord or wire 14 may travel through the individual hanger 16, allowing substantial "give" in the curtain 10 while the curtain is flexing between the folded-up and the folded-out positions, preventing binding of the curtain and tearing out at any one hanger location.

Optionally, the bottom back corner of the curtain 10 is provided with a padlock or combination lock (not shown) so that the corner of the curtain may be raised for occasional ingress to and egress from under the bleachers.

Figure 3A:
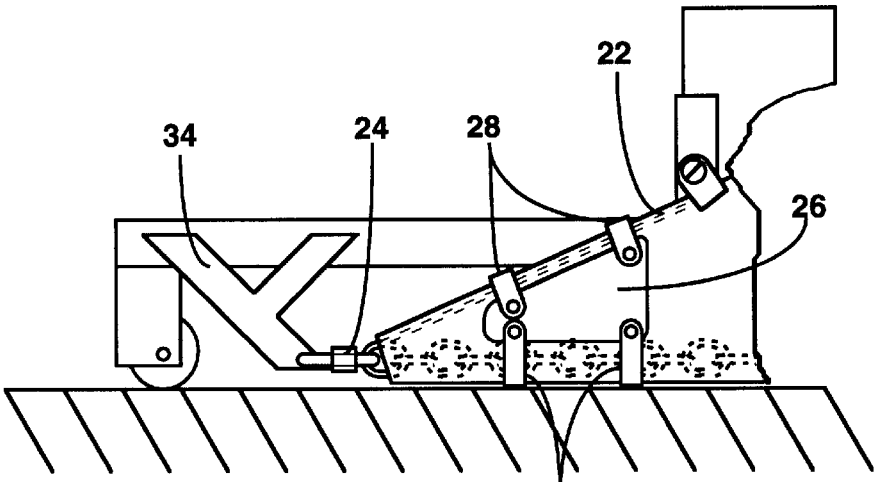
FIGS. 3A, 3B and 3C are partial detail side views of the three corners of the end curtain of one embodiment of the invention, showing its attachment to the seating and the wall of the gymnasium.
Figure 3B:
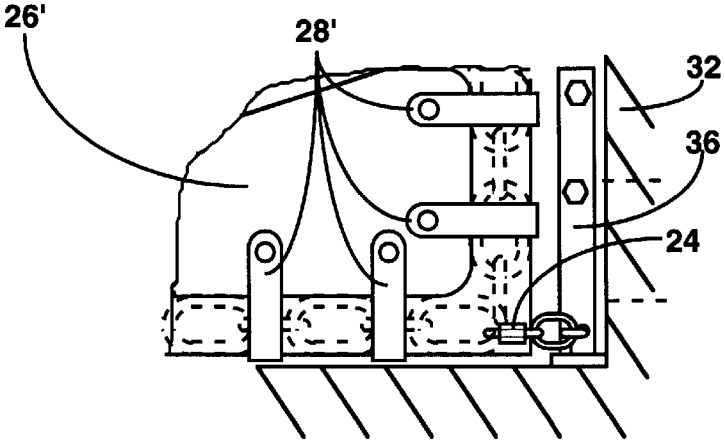
Figure 3C:
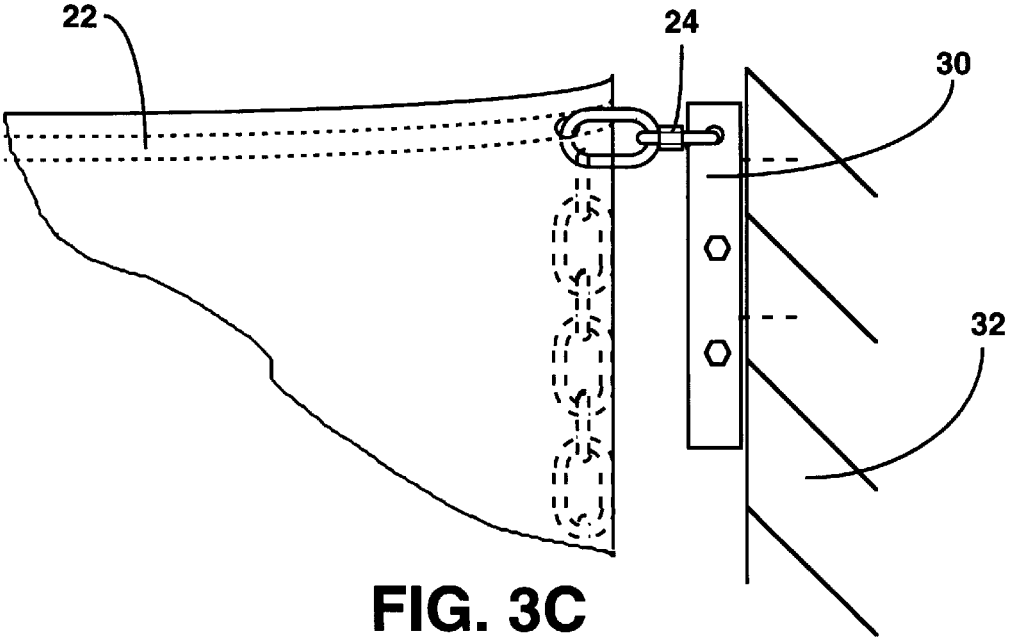
Figure 4:
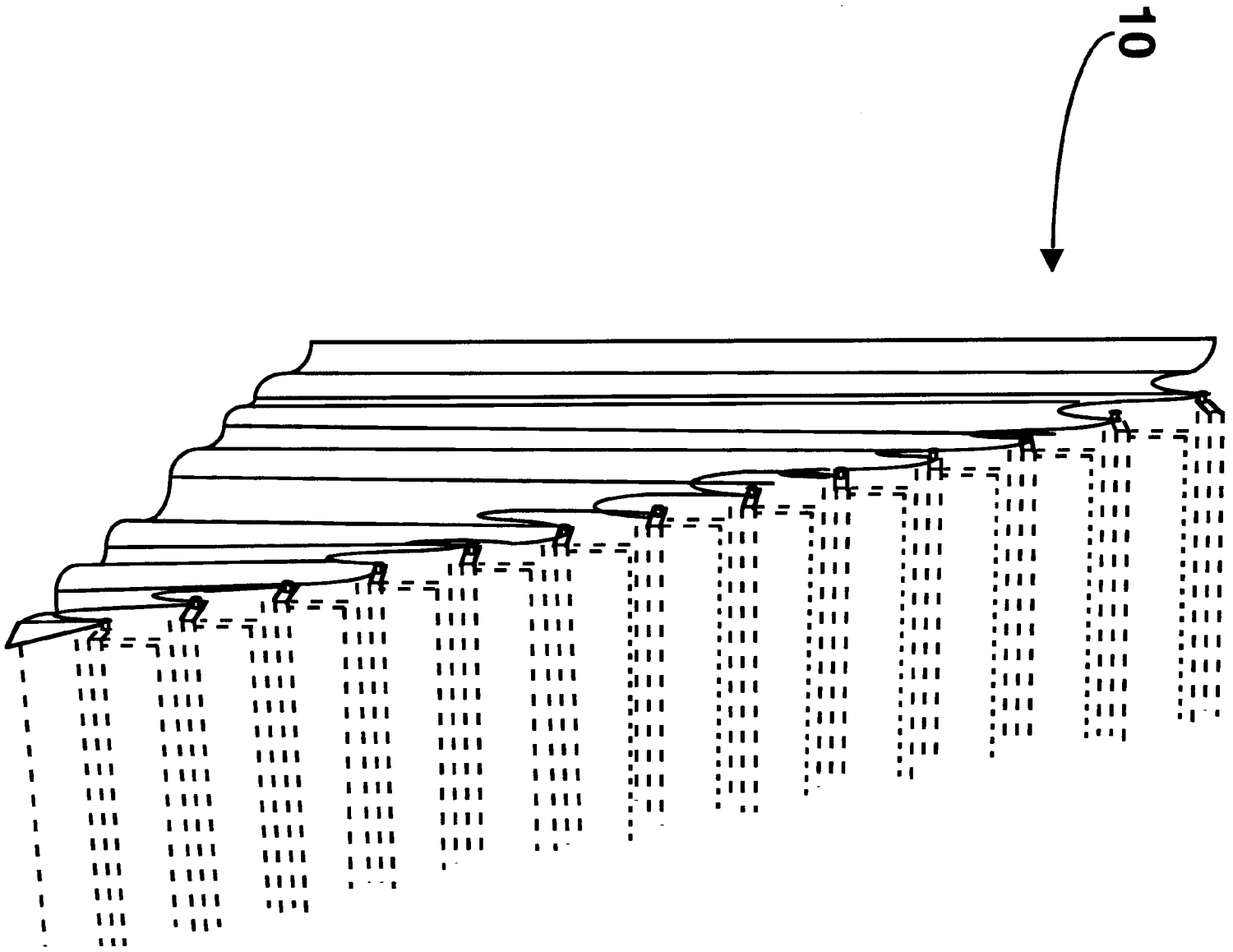
FIG. 4 is a side perspective view of another embodiment of the invention, but in the folded-up position.

Optionally, the corners of the curtain 10 may be reinforced, to improve its durability. Reinforcement plates 26 and 26' and their reinforcement straps 28 and 28' are shown in FIGS. 3A and 3B. Reinforcement plates 26 and 26' may be on one or both sides of the corners of the curtain 10. Or, curtain 10 may be reinforced by other, conventional techniques.

In manufacture, curtain 10, including its seams 12, chains, cables, cords or wires, and reinforcement plates 26 and 26' and reinforcement straps 28 and 28', if any, are cut and shaped to fit the dimensions of the end of the bleachers to be enclosed. Then, looped hangers 16 are installed through the seams 12 at locations preferably corresponding to the back bottom corner of each seating riser on the end edge of the bleacher. Alternatively, the looped hangers 16 may be installed on a custom-fit basis when the end curtain 10 is installed on the bleacher.

In installation, the top back corner of the curtain 10 is connected to a brace 30 connected to gymnasium wall 32 near the top back of the bleacher. Or, brace 30 may be connected to a top, back structural part of the seating which is connected to gymnasium wall 32. Brace 30 may be any conventional brace for receiving the top load of curtain 10. Then, the front bottom corner of the curtain 10 is connected to a brace 34 which is connected to the front bottom corner of the bleacher. Brace 34 may be any conventional brace for receiving the bottom front load of curtain 10. Or, the front bottom corner of curtain 10 may be directly connected to the front bottom corner of the bleachers. Then, the back bottom corner of curtain 10 is connected to a brace 36 connected to gymnasium wall 32 near the bottom back of the bleachers. Or, brace 36 may be connected to a bottom, back structural part of the seating which is connected to gymnasium wall 32. Brace 36 may be any conventional brace for receiving the bottom back load of curtain 10. Then, each looped hanger 16, already enclosing the cable in seam 12 along the hypotenuse side, is fastened to the side edge of the bleacher and the curtain 10 is ready for use.

Although this invention has been described above with reference to particular means, materials and embodiments, it is to be understood that the invention is not limited to these disclosed particulars, but extends instead to all equivalents within the scope of the following claims.

I claim:

1. A Extendable gymnasium seating including a side end enclosing curtain comprising:

a generally triangular piece of flexible fabric with two sides and a hypotenuse;

a seam along the hypotenuse side of said fabric, said seam enclosing a chain, cable, cord or wire; and a plurality of looped hangers spaced apart along said hypotenuse side, said hangers extending through said seam and encircling said chain, cable, cord or wire.

2. The seating of claim 1 wherein there is a seam along the other two sides of the triangular piece of fabric, said seam also enclosing a chain, cable, cord or wire having ends.

3. The seating of claim 2 wherein the ends of the chain, cable, cord or wire in the seam along the other two sides is connected to the ends of the chain, cable, cord or wire in the seam along said hypotenuse side.

* * * * *